US008448712B2

(12) United States Patent
Moeller et al.

(10) Patent No.: US 8,448,712 B2
(45) **Date of Patent: *May 28, 2013**

(54) RE-LATCH MECHANISM FOR WELLBORE LINER SYSTEM

(75) Inventors: Daniel Keith Moeller, Edmond, OK (US); Brock Watson, Sadler, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/613,222

(22) Filed: Sep. 13, 2012

(65) Prior Publication Data

US 2013/0087324 A1 Apr. 11, 2013

Related U.S. Application Data

(63) Continuation of application No. 13/605,692, filed on Sep. 6, 2012, which is a continuation of application No. PCT/US2011/055403, filed on Oct. 7, 2011.

(51) Int. Cl.
*E21B 23/00* (2006.01)

(52) U.S. Cl.
USPC ..... 166/382; 166/242.6

(58) Field of Classification Search
USPC ..... 166/380, 382, 242.6
See application file for complete search history.

(56) References Cited

U.S. PATENT DOCUMENTS

| | | | | |
|---|---|---|---|---|
| 4,289,202 | A | 9/1981 | Henderson | |
| 4,311,194 | A | 1/1982 | White | |
| 5,209,303 | A * | 5/1993 | Barrington | 166/374 |
| 5,462,121 | A * | 10/1995 | Schmuck et al. | 166/383 |
| 7,210,534 | B2 * | 5/2007 | Hayter et | 166/386 |
| 7,401,651 | B2 * | 7/2008 | Shkurti | 166/308.1 |
| 7,980,316 | B2 * | 7/2011 | Swenson et al. | 166/386 |
| 2004/0060701 | A1 | 4/2004 | Harmon et al. | |
| 2004/0060710 | A1 | 4/2004 | Marshall | |

OTHER PUBLICATIONS

Authorized Officer Kwak Joong Hwan, International Search Report and the Written Opinion of the International Searching Authority for Application No. PCT/US2011/055403 dated Apr. 17, 2012, 13 pages.
Halliburton, VersaFlex Expandable Liner System, (publicly available prior to Sep. 6, 2012), available at http://www.halliburton.com/public/cps/contents/Books_and_Catalogs/web/CPSCatalog/05_VersaFlex.pdf (last visited Sep. 6, 2012) (10 pages).

* cited by examiner

*Primary Examiner* — William P Neuder
(74) *Attorney, Agent, or Firm* — Paul Herman; Fish & Richardson P.C.

(57) ABSTRACT

A tool for releasably coupling a first tubing to a second tubing in a wellbore has a tubular mandrel configured to couple to and be carried into the wellbore by the first tubing. A collet ring is in an interior of the mandrel and has a plurality of collets to engage the second tubing. A releasing piston is carried in the interior of the mandrel to change between supporting the collet ring such that the collets can release from the profile and allowing the collet ring to lock such that the collets are locked in the profile.

23 Claims, 5 Drawing Sheets

RE-LATCH MECHANISM FOR WELLBORE LINER SYSTEM

CROSS-REFERENCE TO RELATED APPLICATIONS

This application is a continuation of, and claims priority under 35 U.S.C. §120 to, U.S. patent application Ser. No. 13/605,692, filed Sep. 6, 2012, which claims priority under 35 U.S.C. §120 to International Application No. PCT/US2011/055403, filed Oct. 7, 2011, the entire contents of both previous applications are hereby incorporated by reference.

BACKGROUND

The present disclosure relates to coupling tubulars in a wellbore.

An expandable wellbore liner is a type of wellbore liner that is intended to be radially, plastically deformed while in a wellbore. Such liners are often set in another tubular or against the bare wall of the wellbore by radially, plastically deforming the expandable liner into gripping and/or sealing engagement with the other tubular or the bare wall of the wellbore. For example, an expandable liner can be set near the foot of a casing and extend downhole into a wellbore, or hung from other liners that extend downhole into the wellbore, to line an additional portion of the wellbore below the casing or liner. In another example, an expandable liner can be set proximate a rupture, leak or otherwise weakened portion of a casing or liner as a repair measure to reinforce and/or seal the casing or liner.

Wellbore liners incorporating expandable liners are typically assembled to and carried into the wellbore on a setting tool. Thereafter, the setting tool is operated to radially, plastically expand the expandable liner. The setting tool couples to the expandable liner via collets that engage a profile in the liner. After expansion, the setting tool is released from the liner by releasing the collets from the profile.

SUMMARY

The present disclosure relates to wellbore liner systems that include a tool to couple the profile in the liner to a tieback string that is run from an end of the liner to the terranean surface.

The disclosure encompasses a tool for releasably coupling a first tubing to a second tubing in a wellbore. A tubular mandrel of the tool is configured to couple to and be carried into the wellbore by the first tubing. A collet ring is carried in an interior of the mandrel. The collet ring has collets that extend from the interior of the mandrel to an exterior of the mandrel through openings in the mandrel. The collet ring can axially translate between a locked position and a released position. In the locked position the collets are supported radially outward by the mandrel to engage the second tubing thereby coupling the first and second tubing. In the released position the collets are unsupported and allowed to retract radially inward out of engagement with the second tubing and allow the first tubing to uncouple from the second tubing. A releasing piston is carried in the interior of the mandrel to translate axially between a supporting position supporting the collet ring in the released position and an unsupporting position allowing the collet ring to translate to the locked position. The releasing piston is releasably retained in the unsupporting position until hydraulic pressure is applied against the releasing piston to move the releasing piston to the supporting position.

The disclosure encompasses a method where a second tubing in a wellbore is engaged with collets carried by a tubular mandrel coupled to a first tubing. The collets extend from the interior of the mandrel to the exterior of the mandrel. The mandrel and the first tubing are moved relative to the collets to position a surface of the mandrel radially under the collets and support the collets locked in engagement with the second tubing.

The disclosure encompasses a device for coupling a first tubing to a second tubing in a wellbore. The device has a tubular mandrel for coupling to the first tubing. Collets are carried on spring fingers that extend from an interior of the tubular mandrel to an exterior of the tubular mandrel. The collets, when in a first position, are supported radially outward by an outward facing surface of the mandrel. The collets, when in a second position, are allowed to retract radially inward.

Particular implementations of the subject matter described here can be implemented to have one or more of the following potential advantages. The collet profile that is used to set liners using an expandable liner hanger can be utilized in subsequent operations after the liner hanger has been released from the hanger. In addition to anchoring a tieback assembly, the tool can be used to fish or reposition the expandable liner hanger prior to setting the expandable liner hanger. The tool described here can be implemented in other applications in which putting the hanger in tension or rotating the hanger is desirable. Additionally, since the release mechanism is pressure activated, the possibility of placing the tool in a state in which it is pre-released or unable to be set can be decreased. Also, being able to re-latch into the collet profile can allow for the saving of costs associated with not having to machine another profile for another latch.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
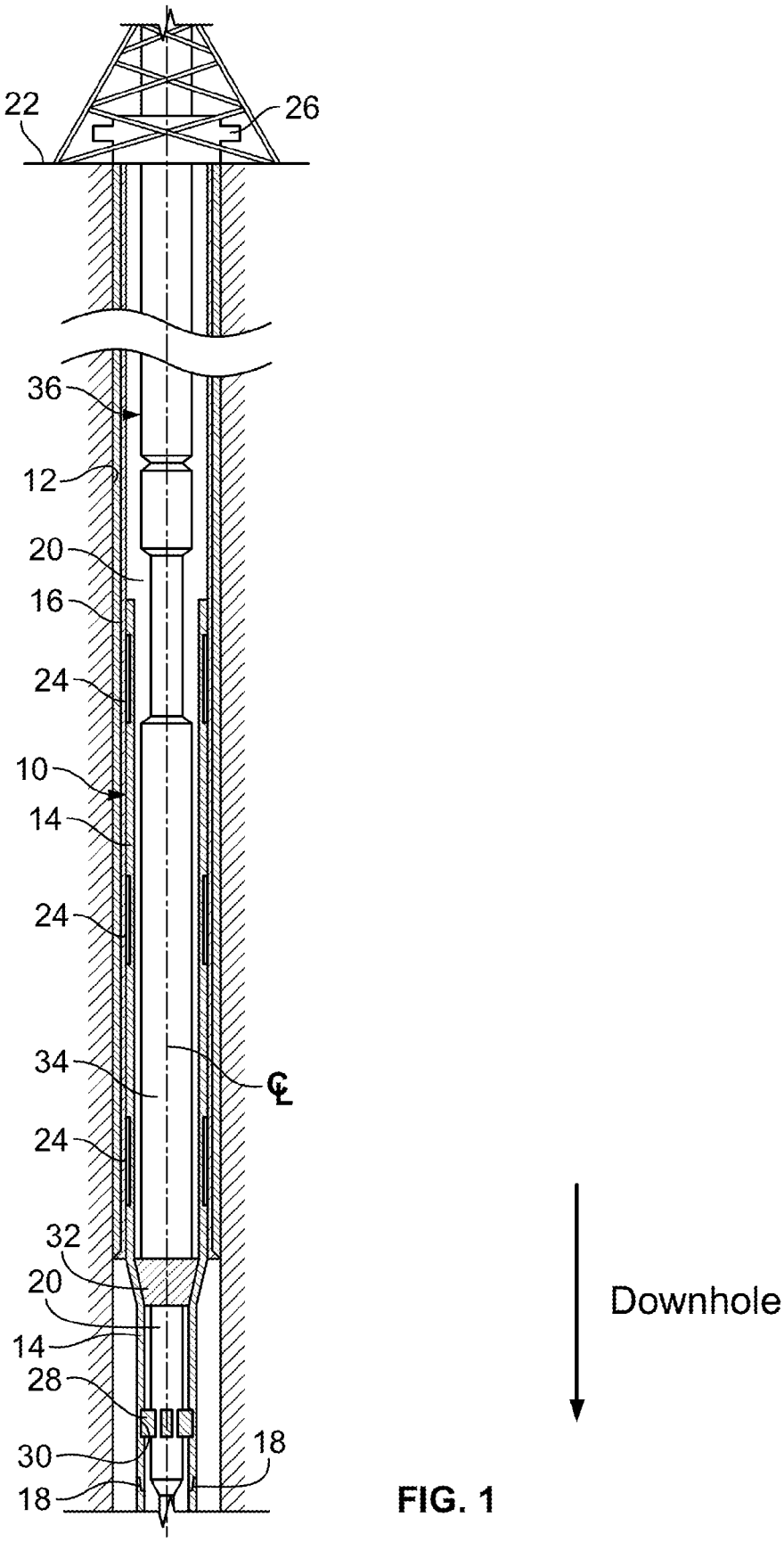
FIG. 1 is a view of an example liner system residing in a wellbore. For convenience of reference, "uphole" is toward the top of the figure and "downhole" is toward the bottom of the figure.

Referring first to FIG. 1, an example wellbore liner system 10 is shown residing in wellbore 12. The example liner system 10 includes an expandable wellbore liner system having an expandable liner hanger 14 and a liner sub-assembly 18 of other liner components depending from the downhole end thereof. FIG. 1 shows the expandable liner hanger 14 having been radially, plastically deformed by a setting tool 20 so that its outer diameter continuously engages the interior diameter of the casing 16. In FIG. 1, the setting tool 20 is depicted as having been operated to deform the expandable liner hanger 14.

The wellbore 12 extends substantially vertically from a terranean surface 22 into the Earth. Although the wellbore 12 is depicted as being substantially vertical, in other instances, the entire wellbore or portions thereof may deviate to be slanted, curved substantially horizontal or otherwise non-vertical. Similarly, although the wellbore 12 is depicted as being a single wellbore, in other instances the wellbore can be a multilateral configuration that has one or more lateral wellbores branching therefrom. The wellbore 12 provides access for injecting fluids into or withdrawing fluids from one or more subterranean zones of interest, where a subterranean zone of interest can correspond to a particular geological formation, can be a portion of a geological formation, or can include two or more geological formations. The casing 16 extends from a wellhead 26 at the surface 22 and through a portion of the wellbore 12. In certain instances, the casing 16 is cemented and/or otherwise affixed to the walls of the wellbore 12. In certain instances, the casing 16 is unapertured wall tubing.

The liner sub-assembly 18 can include one or more lengths of tubular liner, including unapertured wall tubing, slotted and/or apertured tubing, sand screen and/or other liner. If the liner sub-assembly 18 includes multiple lengths, the multiple lengths can be coupled together end to end (threadingly and/or otherwise) to define the liner sub-assembly 18. The liner sub-assembly 18 can also include other components, such as valves, seals, centralizers, and/or other components. In certain instances, the downhole end of the liner sub-assembly 18 can include provisions to attach to additional components (threadingly and/or otherwise). The downhole end of the expandable liner hanger 14 includes provisions to couple to the liner sub-assembly 18 (threadingly and/or otherwise).

The expandable liner hanger 14 is shown engaging the downhole end of the casing 16, such that the expandable liner hanger 14 and the liner sub-assembly 18 extend from the downhole end of the casing 16 further into the wellbore 12. In other instances, the expandable liner hanger 14 and liner sub-assembly 18 can be positioned elsewhere within the wellbore 12 and/or in other associated wellbores. For example, in the context of a casing repair, the expandable liner hanger 14 can be positioned uphole from a rupture, leakage, or otherwise weakened point in the casing 16. In another example, in the context of a multilateral configuration, the expandable liner hanger 14 can be positioned proximate a lateral branch with the liner hanger extending into the lateral branch. Still further examples exist, and more than one liner hanger 14 and liner sub-assembly 18 can be provided in the wellbore 12.

In FIG. 1, the expandable liner hanger 14 includes one or more seals 24 (three shown) circumscribing the outer diameter of the expandable liner hanger 14. The seals 24 facilitate sealing between the expandable liner hanger 14 and the casing 16 when the outer diameter of the expandable liner hanger 14 engages the inner diameter of the casing 16. In certain instances, the seals 24 form a gas-tight seal between the expandable liner hanger 14 and the casing 16. In other instances, the seals 24 can be omitted.

The setting tool 20 is a component of a working string 36 that extends from the surface 22 into the wellbore 12. In addition to the setting tool 20, the working string 36 includes tubing (e.g., jointed tubing, continuous tubing without joints (e.g., coiled tubing), and/or other types of tubing) and/or other components. The setting tool 20 carries the expandable liner hanger 14 and liner sub-assembly 18 into the wellbore 12, and operates to radially, plastically deform the expandable liner hanger 14 into engagement with the casing 16 by driving an expansion cone through the interior of the liner hanger 14. The expansion cone of the setting tool 20 has a larger outer diameter than the unexpanded inner diameter of the liner hanger 14, and thus, when driven through the interior of the liner hanger 14, diametrically expands the liner hanger 14. The setting tool 20 includes radially extendable and retractable latching lugs 28 that couple the setting tool 20 with a profile 30 of the expandable liner hanger 14. FIG. 1 shows the setting tool 20 coupled to the expandable liner hanger 14, with lugs 28 radially extended into engagement with a profile 30 of the expandable liner hanger 14. When coupled to the expandable liner hanger 14, the lugs 28 can axially support the expandable liner hanger 14, the liner sub-assembly 18 and any additional components associated there with. Furthermore, the lugs 28 react against the profile 30 of the liner hanger 14 in driving the expansion cone through the liner hanger 14. After the liner hanger 14 is expanded to grip and seal with the casing 16, the setting tool 20 can be decoupled from the expandable liner hanger 14 by allowing the lugs 28 to radially retract out of engagement with the profile 30. Thereafter, the working string 36 (including setting tool 20) can be withdrawn from the wellbore 12.

In certain instances, after the working string 36 has been withdrawn from the wellbore 12, it is desirable to couple, or tie back, the liner system to a location uphole, such as the wellhead at the surface, another liner system and/or another location. The liner system can be coupled or tied back to the location uphole by coupling a tieback string, including tubing and/or other components, to the liner hanger 14 and to the location uphole such that the tieback string spans between the liner hanger 14 and the location uphole.

Figure 2:
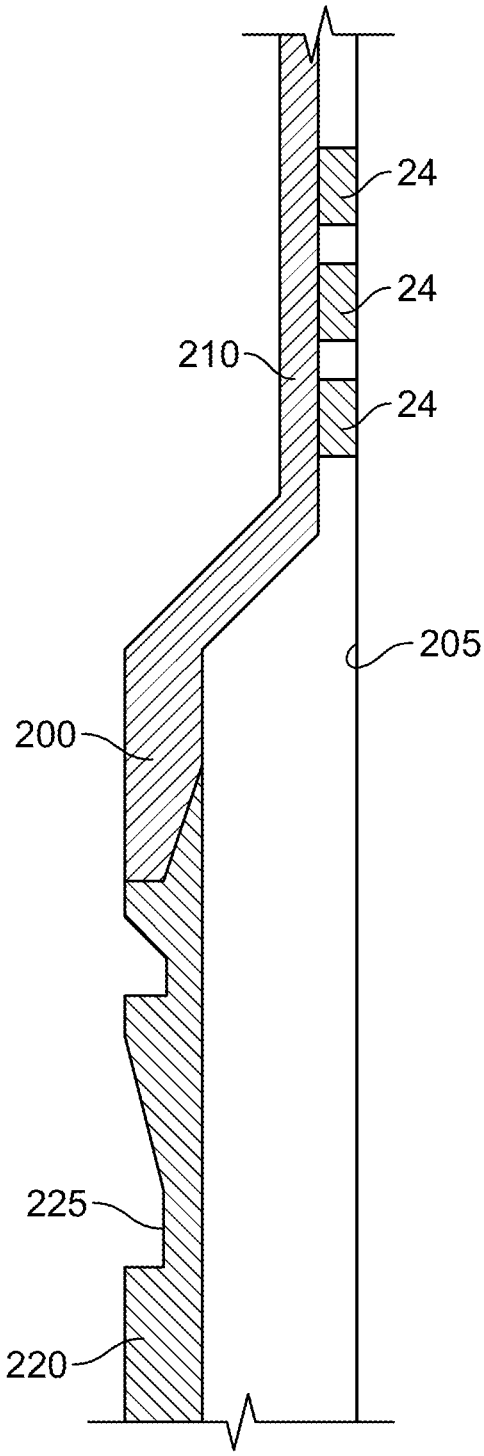
FIG. 2 is a partial detail side cross-sectional view of an example liner residing in the wellbore and illustrates a profile in the example liner to which the setting tool engages.

Turning now to FIG. 2, FIG. 2 is a detail view of an example liner system residing in the wellbore and illustrates a profile to which the setting tool engages. As shown in FIG. 2, the liner hanger 200 is sealed against the wall 205 of the wellbore (interior diameter of rough bore or casing). The interior of the liner hanger 200 defines a polished bore receptacle 210 having a surface roughness controlled inner surface (e.g., machined and/or honed to have a specified surface roughness) to facilitate sealing with another tubular. A setting sleeve 220 resides at a downhole end of the liner hanger 200. A profile 225 (for example, the profile 30 of the expandable liner hanger 14) is defined in the setting sleeve 220. In accordance with the concepts described herein, a coupling tool of a tieback string can engage the same profile 225 and seal with the polished bore receptacle 210 in tying back the liner system to a location uphole.

Figure 3:
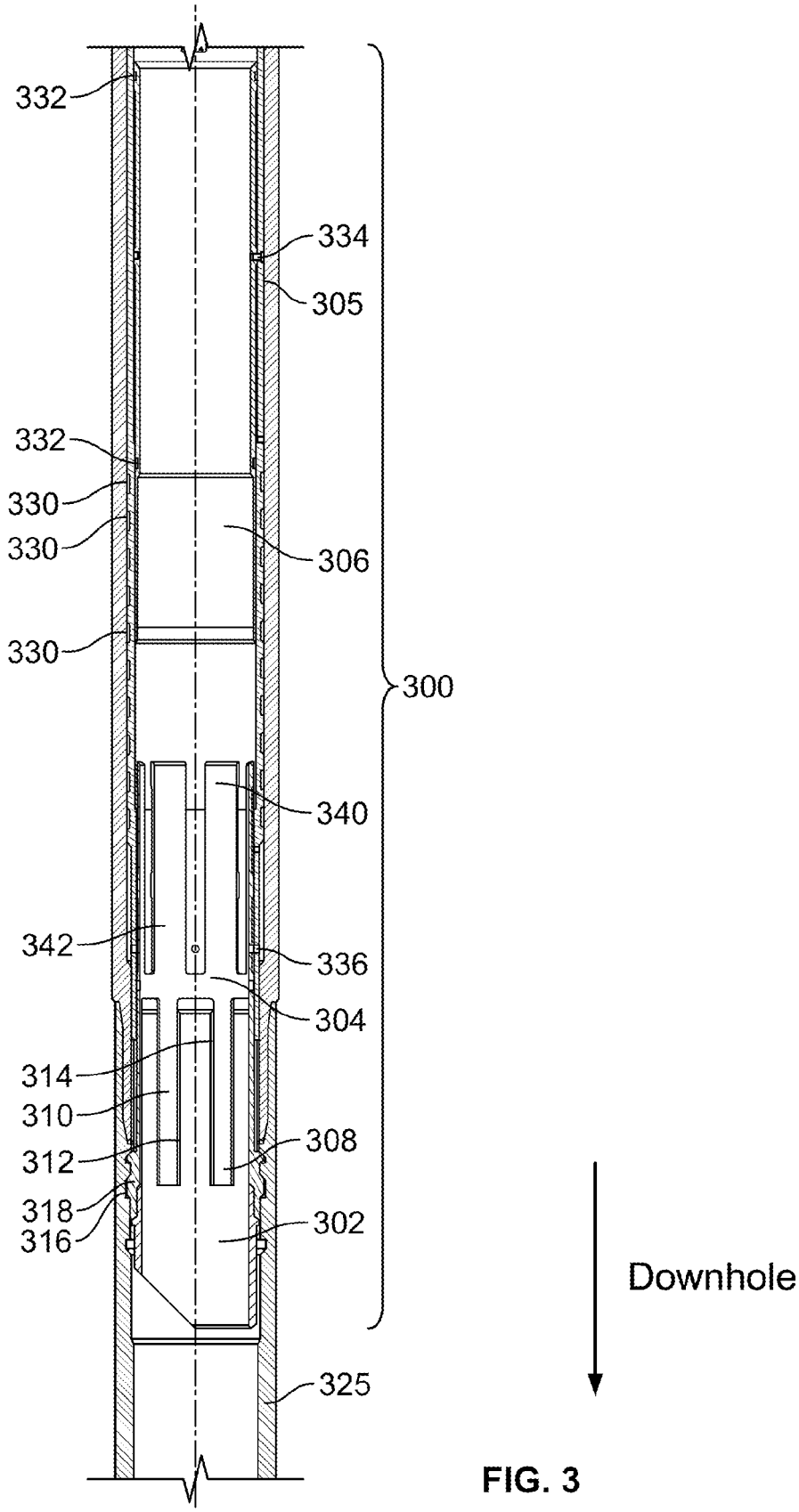
FIG. 3 is a partial detail side cross-sectional view of an example coupling tool to couple a tieback string to the liner hanger and the liner.

FIG. 3 is a partial side cross-sectional view of an example coupling tool 300 shown in the context of coupling a tieback string to a liner hanger 305 and the liner. In FIG. 3, the coupling tool 300 is a component of the tieback string and the coupling tool 300 is shown as engaging a liner hanger 305 of the liner system. As described previously, the liner hanger 305 is an expandable type that is plastically deformed into the wall of the wellbore to grip and seal with the wall of the wellbore. The tieback string (including the coupling tool 300) extends from the liner hanger 305 to a location uphole. The coupling tool 300 includes a mandrel 302 configured to couple (threadingly and/or otherwise) to and be carried in to the wellbore by the remainder of the tieback string. Further, the mandrel 302 is configured to seal with the polished bore receptacle defined by the liner hanger 305. As shown, the tool 300 can include multiple seals 330 positioned on an exterior surface of the mandrel 302 that are positioned to seal with the surface roughness controlled interior bore of the polished bore receptacle in the expandable liner hanger 305. The mandrel 302, itself, defines an internal, central, axial bore.

The tool 300 further includes a collet ring 304 in the interior bore of the mandrel 302. The collet ring 304 is annular and includes multiple collets, for example, collets 308, 310, each on a radially, inwardly flexible spring finger extending from an annular portion of the collet ring 304 and each configured to engage with the profile of the liner hanger 305. Each spring finger carries its respective collet with its outer surface at a diameter equal to an inner diameter of the profile of the liner hanger 305 when the spring finger is not radially flexed. The collets extend from within the interior bore of the mandrel 302 to the exterior of the mandrel through multiple openings, for example, openings 312, 314 in the mandrel 302.

The collet ring 304 is carried in the interior of the mandrel to axially translate between a locked position and a released position. In the locked position (downhole relative to the mandrel 302 as shown in FIG. 3), the collets 308, 310 are supported radially outward to engage a profile 316 of the liner hanger 305, thereby locking the tieback string in a coupled arrangement with the liner hanger. In the released position (uphole relative to the mandrel 302), the collets 308, 310 are unsupported and can move radially inward through the openings in the mandrel 302, out of engagement with the profile 316 and allow the coupling tool 300 to uncouple from the liner hanger 305. When the collet ring 304 is in the locked position, the collets 308 rest on an outer surface of the mandrel 302, and the outer surface supports the collet ring 304 radially outward (i.e., so they cannot move inward) into engagement with the profile 316. The collets 308, 310 abut an uphole facing shoulder on the outer surface of the mandrel 302, such that axial loads between the liner hanger 305 and the mandrel 302 are transmitted directly through the collets 308, 310. When the collet ring 304 is in the released position, the collets 308 are apart from the outer surface of the mandrel 302 and are allowed to move radially inward through the openings 312. Initially, a shear pin 336 (or other mechanism) retains the collet ring 304 in the released position while the coupling tool 300 is run into the wellbore 12 and into the liner hanger 305.

In certain instances, the collets 308, 310 engage the profile 316 in such a manner that the collets will not slip relative to the liner hanger 305 when torsional loads are applied through the collets. For example, the exterior surface of the collets 308, 310 can be keyed to the profile 316 (e.g., with a key and keyway configuration, the collets 308, 310 sized to fit in corresponding pockets of the profile 316, and/or in another manner). Similarly, the interior surface of the collets 308, 310 can be keyed to the exterior of the mandrel 302 (e.g., with a key and keyway configuration, the collets 308, 310 sized to fit in corresponding pockets on the mandrel 302, and/or in another configuration). Accordingly, with the collets 308, 310 keyed to both the profile 316 and the mandrel 302, the collets 308, 310 can transmit torque between the mandrel 302 and the liner hanger 305. The torque loads between the mandrel 302 and the liner hanger 305 are transmitted directly through the collets 308, 310.

In certain instances, because the axial loads and torque is transmitted directly through the collets 308, 310 and not through any other portion of the collet ring 304, the remaining structure of the collet ring 304 can be relatively thin (radially) and need not be sized to carry the axial or torsional loads. The simplicity of the collet ring 304 and the mechanism by which it is supported and unsupported (i.e., with few parts) also contribute to a thinner collet ring 304. Having a radially thin collet ring 304 allows a large bore through the coupling tool 300, which in turn, allows passage of tools and other strings through the interior of the coupling tool 300.

The tool 300 also includes a releasing piston 306 that is carried in the interior of the mandrel 302 to translate axially between a collet ring supporting position and a collet ring unsupporting position. In the collet ring supporting position (downhole relative to the mandrel 302 as in FIG. 4A, and resting on an interior shoulder of the mandrel 302), the releasing piston 306 supports the collet ring 304 in the released position (i.e., such that the collets can release from the profile). In the unsupporting position (uphole relative to the mandrel as in FIG. 3), the releasing piston 306 does not support the collet ring 304 and allows the collet ring 304 to translate to the locked position (i.e., such that the collets are locked into engagement with the profile).

Figure 4A:
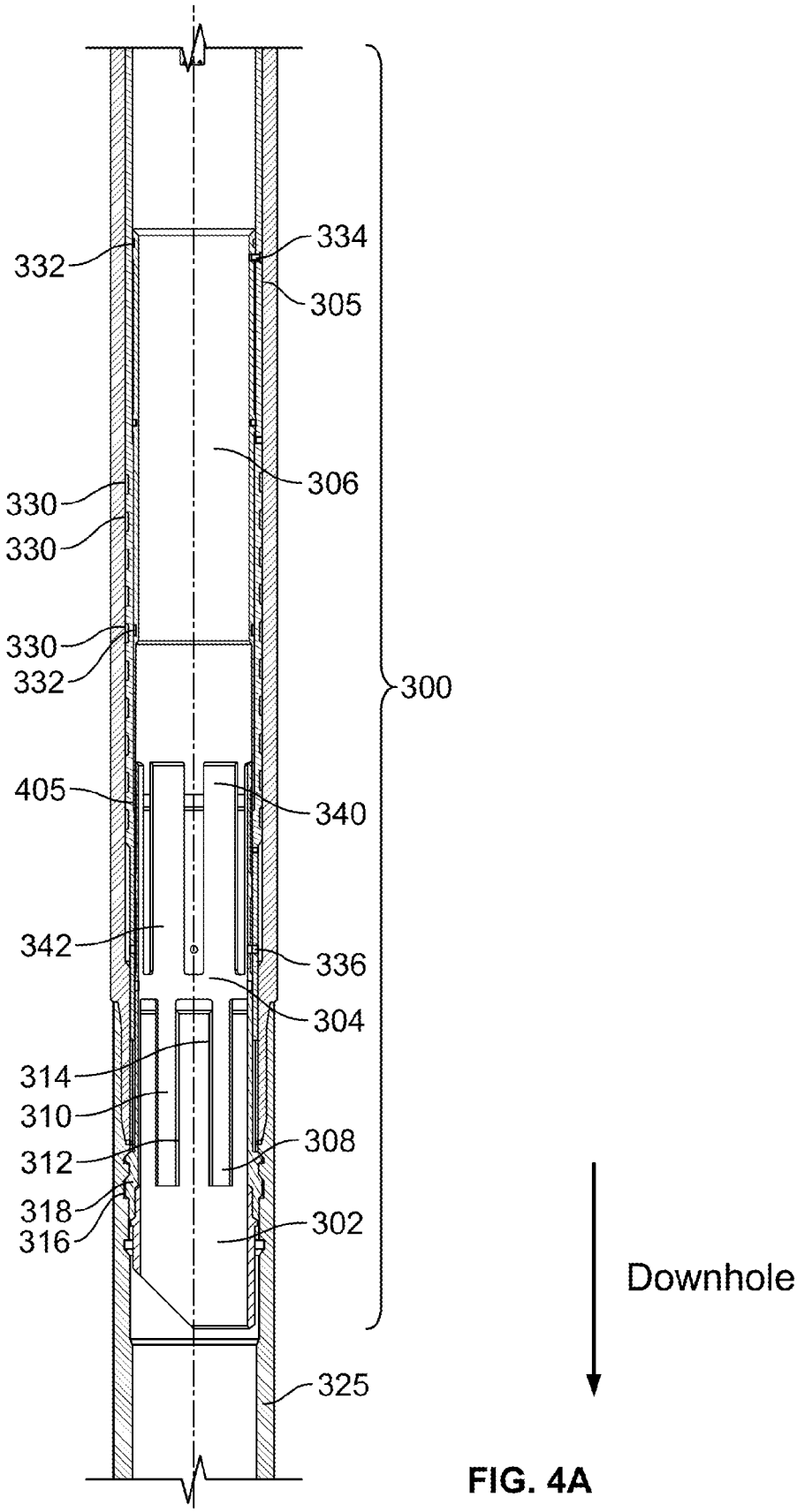
FIG. 4A is a partial detail side cross-sectional view of an example coupling tool that is pressured up to activate the release piston.

The releasing piston 306 defines a volume in an annulus between an outer surface of the piston and an inner surface of the mandrel 302. The releasing piston includes multiple seals 332 axially bounding the volume. The tool 300 includes a port that communicates the piston volume with an annulus between the outer diameter of the mandrel 302 and the inner diameter of the liner hanger 305. Thus, pressure applied in this annulus can shift the releasing piston 306 from the unsupporting position (FIG. 3) downhole to the supporting position (FIG. 4A). Initially, the releasing piston 306 is releasably retained in the unsupporting position (FIG. 3) with a shear pin 334 until pressure is applied to the piston volume to move the releasing piston 306 to the supporting position.

The collet ring 304 includes uphole collets 340, 342 configured to couple to and retain the collet ring 304 in the releasing piston 306 when the releasing piston 306 is in the supporting position and the collet ring 304 is in the released position.

In operation, with the tool 300 coupled in the tieback string, it is lowered from the terranean surface toward the downhole end of the wellbore and received in the liner hanger 305. The seals 330 of the mandrel 302 seal with the interior of the polished bore receptacle, and form a liquid and/or gas tight connection between the tieback string and the liner hanger 305. The collets 308 of the collet ring 304 engage the profile 316 in the interior of the liner hanger 305 and couple the tieback string to the liner hanger 305. The collet ring 304 is retained in a released position by shear pin 336, and the releasing piston 306 is retained in the unsupporting position by shear pin 334.

When the collets reach the profile 316, the tieback string can be rotated to shear the shear pin 336. Alternatively, the weight of the tieback string can be set down on the collet ring 304. Once the shear pin 336 connecting the collet ring 304 to the mandrel 302 is sheared, the tieback string is lifted uphole. As the tieback string is lifted uphole, the collet ring 304 shifts downhole (relative to the mandrel 302) to the locked position. The engagement between the collets and the profile of the liner hanger 305 holds the collets as they ride up over the outer surface of the mandrel 302 and are prevented from moving inward. Tension is maintained on the tieback string to maintain the coupling with the liner hanger 305, for example, using a latch mechanism, slips, and/or other similar mechanism uphole.

With the downhole end of the tieback string engaged with the profile 316 of the liner hanger 305 and the uphole end engaged with the uphole location, a fluid tight connection is formed between the tieback string and the liner hanger 305. The seals 330 prevent fluid from flowing through an annulus between the mandrel 302 and the liner hanger 305. Fluids can now be run through the tieback string.

Subsequently releasing the tieback string is described with reference to FIGS. 4A-C. Referring first to FIG. 4A, as described previously, the tool 300 includes a port that communicates the piston volume with an annulus between the outer diameter of the mandrel 302 and the inner diameter of the liner hanger 305. To disengage the collet ring 304 from the profile 316, a pressure differential is created between an exterior of the releasing piston 306 and an interior of the tieback string to cause the releasing piston 306 to translate axially from the unsupporting position, downhole to the supporting position.

As the releasing piston 306 translates downhole, the uphole collet profiles 340, 342 engage the releasing piston 306 and the releasing piston 306 comes to rest on an interior shoulder 405 of the mandrel 302. Thus, with the releasing piston 306 now in the supporting position, the collet ring 304 is axially supported relative to the mandrel 302, because the uphole collet profiles 340, 342 have engaged the releasing piston 306, and also because the releasing piston 306 is abutting and carried by the shoulder 405.

Figure 4B:
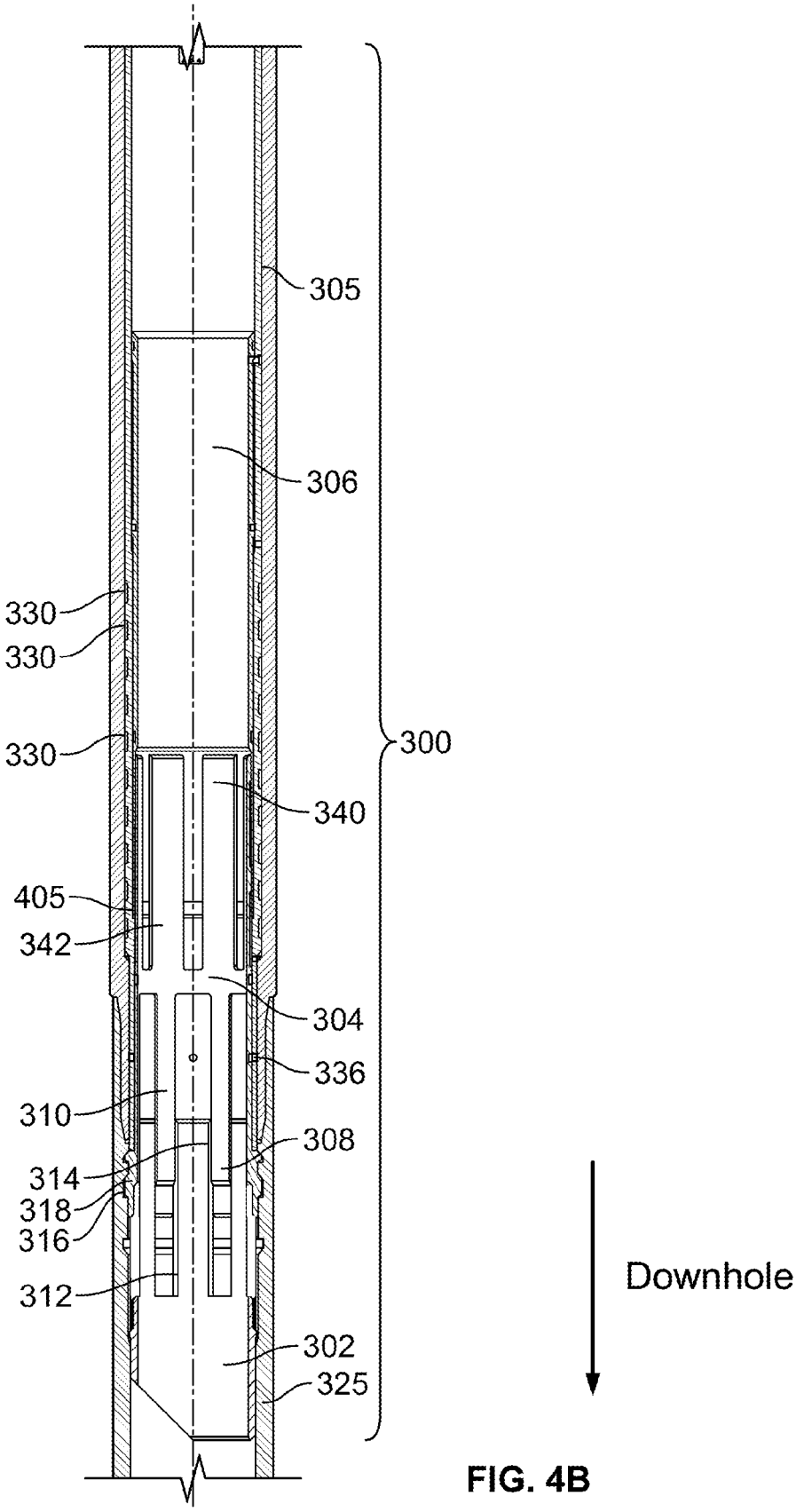
FIG. 4B is a partial detail side cross-sectional view of an example coupling tool that has been set down to be released from the profile of the liner hanger.

FIG. 4B is a view of an example coupling tool 300 that has been set down to be released from the profile of the liner hanger 305. After the uphole collet profiles 340, 342 have engaged the releasing piston 306, the tieback string is shifted downhole. This shifts the mandrel 302 downhole relative to the collet ring 304 and the collet ring 304 to the released position. The collets align with the openings in the mandrel 302 and become unsupported, and are free to spring radially inward.

Thereafter, the example tool 300 can be pulled out of the wellbore. As the tieback string is withdrawn uphole from the wellbore, the uphole collet profiles 340, 342, engage a square shoulder on the releasing piston 306 and support the collet ring 304 in the released position (with the collets free to spring inward out of engagement with the profile). The releasing piston 306 shoulders against the mandrel 302 and supports the collet ring 304 as the collets are pulled free from the profile. Thereafter, the tieback string is withdrawn uphole and can be withdrawn from the wellbore.

Notably, although the coupling tool 300 has been described herein in connection with a tieback string, the tool 300 can be implemented in other contexts. For example, the coupling tool 300 can be used on the end of working string as a fishing device, for example, to grip the profile 316 of the liner system and lift the liner and the liner hanger to the terranean surface. In another example, the coupling tool 300 can be used in coupling two other tubulars (other than a tieback string and liner system) in a wellbore. Also, of note, the coupling tool 300 is described herein as engaging an existing profile in the well, and thus, there is no need to provide a separate profile.

A number of implementations have been described. Nevertheless, it will be understood that various modifications may be made. Accordingly, other implementations are within the scope of the following claims.

What is claimed is:

1. A tool for releaseably coupling a first tubing to a second tubing in a wellbore, the tool comprising:

a tubular mandrel configured to couple to and be carried into the wellbore by the first tubing;

a collet ring in an interior of the mandrel and comprising a plurality of collets that extend from the interior of the mandrel to an exterior of the mandrel through a plurality of openings in the mandrel, the collet ring carried in the interior of the mandrel to axially translate between:

a locked position where the collets are supported radially outward by the mandrel to engage the second tubing thereby coupling the first and second tubing, and a released position where the collets are unsupported and allowed to retract radially inward out of engagement with the second tubing and allow the first tubing to uncouple from the second tubing; and a releasing piston carried in the interior of the mandrel to translate axially between a supporting position supporting the collet ring in the released position and an unsupporting position allowing the collet ring to translate to the locked position, the releasing piston releasably retained in the unsupporting position until hydraulic pressure is applied against the releasing piston to move the releasing piston to the supporting position.

2. The tool of claim 1, wherein the second tubing comprises an expandable liner hanger and the collets engage a profile of the second tubing used by an expander tool in radially plastically deforming the liner hanger to an expanded state where the liner hanger engages a wall of the wellbore.

3. The tool of claim 2, wherein the first tubing is a tieback string.

4. The tool of claim 2, wherein the expandable liner hanger is in the expanded state.

5. The tool of claim 1, wherein the collets are configured to engage a profile in the second tubing, and wherein the collet ring is configured as an annular ring having a plurality of radially inwardly flexible spring fingers, each spring finger carrying one of the plurality of collets at a diameter equal to an inner diameter of the profile of the second tubing when the spring finger is not radially flexed.

6. The tool of claim 1, further comprising a plurality of seals positioned on an exterior surface of the mandrel and adapted to seal with an interior surface of the second tubing.

7. The tool of claim 1, wherein the collet ring includes a second plurality of collets that engage and grip the releasing piston to retain the collet ring in the released position.

8. The tool of claim 1, wherein an outer surface of the mandrel is configured to support the collets radially outward when the collet ring is in the locked position.

9. The tool of claim 1, wherein an exterior surface of the collets is keyed to an interior of the second tubing with a key and keyway and an interior surface of the collets is keyed to the exterior of the mandrel a key and keyway.

10. The tool of claim 1, wherein the tubular mandrel is configured to be carried into the wellbore by the first tubing into proximity with the second tubing that is separate from the tool.

11. The tool of claim 10, wherein the second tubing is positioned in the wellbore in at least partial contact with a wellbore surface.

12. The tool of claim 1, wherein the tubular mandrel is configured to be carried into the wellbore by the first tubing apart from the second tubing.

13. A method, comprising:

engaging a second tubing in a wellbore with collets carried by a tubular mandrel coupled to a first tubing, the collets extending from an interior of the mandrel through openings in the mandrel to an exterior of the mandrel; and moving the mandrel and the first tubing relative to the collets to position a surface of the mandrel radially under the collets and support the collets locked in engagement with the second tubing.

14. The method of claim 13, wherein engaging the second tubing comprises engaging a profile of an expandable liner hanger with the collets, the profile being the profile used by an expander tool in radially plastically deforming the liner hanger to an expanded state where the liner hanger engages a wall of the wellbore.

15. The method of claim 14, wherein engaging a profile of an expandable liner comprises engaging a profile of an expandable liner in an expanded state.

16. The method of claim 13, wherein moving the mandrel and first tubing comprises moving the mandrel and first tubing uphole; and the method further comprising:

moving the mandrel and the first tubing downhole to move the surface of the mandrel out from under the collets and allowing the collets to release from engagement with the second tubing; and withdrawing the mandrel and first tubing from the wellbore.

17. The method of claim 16, further comprising, before withdrawing the mandrel and first tubing from the wellbore, supporting the collet from moving relative to the mandrel.

18. The method of claim 17, wherein supporting the collet from moving relative to the mandrel comprises shifting a releasing piston, in response to hydraulic pressure applied to the releasing piston, to couple to and support a collet ring carrying the collet from moving relative to the mandrel and preventing the collet from locking in engagement with the second tubing.

19. The method of claim 13, further comprising sealing against flow of fluid between the mandrel and the second tubing.

20. A device for coupling a first tubing to a second tubing in a wellbore, the device comprising:

a tubular mandrel for coupling to the first tubing, the mandrel comprising a plurality of openings;

a plurality of collets carried on spring fingers, the spring fingers extending from an interior of the tubular mandrel to an exterior of the tubular mandrel through the plurality of openings; and the collets in a first position being supported radially outward by an outward facing surface of the mandrel and in a second position being allowed to retract radially inward.

21. The device of claim 20, wherein the second tubing comprises a component of an expandable liner system that has been radially, plastically deformed into engagement with a wall of the wellbore.

22. The device of claim 21, wherein the second tubing comprises an expander tool engaging profile engaging by the expander tool that radially, plastically deformed the component of the expandable liner system, and the collets are adapted to mate with the profile.

23. The device of claim 20, further comprising a piston in the mandrel that moves, in response to hydraulic pressure applied to the piston, to support the collets apart from the first position.

* * * * *